US005634182A

United States Patent [19]

Asanae et al.

[11] Patent Number: 5,634,182

[45] Date of Patent: May 27, 1997

[54] METHOD OF DEVELOPING ELECTROSTATIC LATENT IMAGE

[75] Inventors: Masumi Asanae, Kumagaya; Masahisa Ochiai, Fukaya, both of Japan

[73] Assignee: Hitachi Metals, Ltd., Tokyo, Japan

[21] Appl. No.: 589,393

[22] Filed: Jan. 22, 1996

[30] Foreign Application Priority Data

| | | | |
|---|---|---|---|
| Jan. 25, 1995 | [JP] | Japan | 7-009393 |
| Apr. 4, 1995 | [JP] | Japan | 7-078777 |
| Sep. 26, 1995 | [JP] | Japan | 7-247174 |

[51] Int. Cl.[6] ..... G03G 15/09

[52] U.S. Cl. ..... 399/267; 399/272; 399/274; 399/277

[58] Field of Search ..... 355/251, 253; 118/656–658; 399/267, 268, 272, 273, 274, 277, 279, 281, 282, 283, 284, 286

[56] References Cited

U.S. PATENT DOCUMENTS

| | | | |
|---|---|---|---|
| 4,464,041 | 8/1984 | Haneda et al. | 355/253 X |
| 5,149,914 | 9/1992 | Koga et al. | 355/251 X |
| 5,223,898 | 6/1993 | Fujii et al. | 355/253 X |
| 5,319,337 | 6/1994 | Matsunari et al. | 355/251 X |
| 5,440,378 | 8/1995 | Matsuura | 355/251 |
| 5,467,175 | 11/1995 | Takagaki et al. | 355/253 X |
| 5,488,341 | 1/1996 | Yamamoto et al. | 355/251 X |
| 5,532,804 | 7/1996 | Hirata et al. | 355/251 |
| 5,547,724 | 8/1996 | Kuribayashi | 118/657 X |

FOREIGN PATENT DOCUMENTS

| | | |
|---|---|---|
| 53-42738 | 4/1978 | Japan . |
| 62-201463 | 9/1987 | Japan . |
| 63-39910 | 8/1988 | Japan . |
| 2-220083 | 9/1990 | Japan . |
| 6-274025 | 9/1994 | Japan . |

*Primary Examiner*—Matthew S. Smith

*Attorney, Agent, or Firm*—Morgan, Lewis and Bockius LLP

[57] ABSTRACT

A method of developing an electrostatic latent image on a rotating image-bearing member with a magnetic developer in which a developing roll consist of only a permanent magnet member and the peripheral speed of the developing roll is regulated to be nearly equal to the moving speed of an image-bearing member. With such a construction, an electrophotographic recording apparatus can be miniaturized while producing an image of high quality.

6 Claims, 1 Drawing Sheet

METHOD OF DEVELOPING ELECTROSTATIC LATENT IMAGE

BACKGROUND OF THE INVENTION

The present invention relates to a method of developing an electrostatic latent image on the surface of an image-bearing member with a magnetic developer attracted on the surface of a developer-transporting roll made of an integrally-molded cylindrical permanent magnet.

In an electrophotographic or electrostatic imaging process, an electrostatic latent image on a photoconductive or dielectric surface of an image-bearing member is developed by bringing a magnetic brush of a magnetic developer into contact with the latent image while employing a developing means comprising a permanent magnet member concentrically mounted within a sleeve which is rotatable relatively with the permanent magnet member. Then, the developed toner image is fixed directly or after transferred onto a recording sheet such as plain paper to give a final image.

However, the magnetic brush system likely causes background fogging because the magnetic brush is brought into contact with not only the latent image portion but also non-image portion. To avoid this problem, an electric field generated by a current of D.C. bias superimposed with A.C. bias is applied to the region between the image-bearing member and the sleeve.

FIG. 2 is a schematic cross sectional view showing an electrophotographic imaging apparatus to practice the conventional method. In FIG. 2, a magnetic developer 2 is stored in a toner storage 1. The lower portion of the toner storage 1 partially receives a developing roll 6 comprising a cylindrical permanent magnet member 4 recessed with a plurality of permanent magnets 3 and a hollow cylindrical sleeve 5 made of a non-magnetic metal material such as SUS304. The permanent magnet member 4 is concentrically mounted within the sleeve 5 which is rotatable relative to the permanent magnet member 4.

A photosensitive drum 7 is rotatable in the direction indicated by an arrow and opposed to the developing roll 6 through a gap g. The thickness of a magnetic developer layer on the sleeve 5 is regulated by a doctor blade 8 positioned at an end of the toner storage 1 and opposed to the developing roll 6 through a gap t. An alternating current supply 9 and a direct current supply 10 are connected between the photoconductive drum 7 and the doctor blade 8 to apply a D.C./A.C. superimposed bias. Generally, the gap g is slightly larger than the gap t.

As the sleeve 5 rotates in the direction indicated by an arrow while keeping the permanent magnet member 4 stationary, the magnetic developer 2 is attracted onto the sleeve 5 and transported to a developing zone opposite to the photoconductive drum 7. In the developing zone, a toner in the magnetic developer 2 is attracted to the latent image portion on the photoconductive drum 7 by the force received from the electric field generated by the latent image overcoming the attractive force from the permanent magnet member 4 to the surface of the sleeve 5. The latent image is developed in this manner.

In the above conventional method, the magnetic developer 2 is attracted on the surface of the sleeve 5 by the attractive force from the permanent magnet member 4 and transported by a frictional force between the sleeve surface and the attracted magnetic developer. Therefore, the exterior circumferential surface of the sleeve 5 is roughened by a blast finishing to effectively transport the magnetic developer 2. However, since the coefficient of friction becomes low due to wearing of the sleeve surface with the use, the thickness of the magnetic developer layer changes to result in deteriorated developability.

In addition, the developing roll 6 is assembled by mounting the permanent magnet member 4 concentrically within the sleeve 5. This complicated assembly operation leads to increased production cost.

In order to miniaturize a printer, etc., proposed is a sleeveless method in which only the rotatable permanent magnet member 4 is employed to develop the latent image by a magnetic brush system (for example, JP-A-62-201463). In this method, the upper half of the magnetic brush is brought into contact with the surface of the photoconductive drum 7.

However, the above sleeve-less magnetic brush method involves a problem of uneven image density, and particularly in forming halftone image, an image of deteriorated quality is produced because of the differences in the heights and developability between the magnetic brushes positioned on the magnetic poles and those positioned between the magnetic poles. The uneven image density may be avoided by rotating the permanent magnet member 4 at higher speed. However, this makes the driving torque larger and generates a tremendous noise.

Therefore, the peripheral speed Vm of the permanent magnet member 4 is usually set to at least about 1.5 times the peripheral speed Vp of the photoconductive drum 7. However, since the magnetic developer 2 on the permanent magnet member 4 is always brought into contact with the surface of the photoconductive drum 7, the magnetic developer 2 is swept toward the rotation direction of the permanent magnet member 4 to result in deteriorated image quality. Further, the increased peripheral speed Vm involves another problem of uneven image density, namely, a printed image, especially in a solid black image, has higher density in a portion developed later as compared with the other portion in the printed image.

To remove this defect, it has been proposed to set the moving speed of the magnetic developer nearly the same as or less than 1.9 times the peripheral speed of the photoconductive drum 7 (JP-B-63-39910 and JP-A-6-274025). However, the apparatus used therein has a developing roll comprising a permanent magnet member and a sleeve, and therefore, involves the problem of complicated assembly operation. In particular, since the apparatus disclosed in JP-B-63-39910 is operated by rotating both the permanent magnet member and the sleeve, a more complicated driving system is required, thus preventing the miniaturization of the apparatus.

In addition to the above method, also proposed is a sleeveless magnetic brush method in which only a rotatable magnetic roller, at least the exterior circumferential portion thereof being made of an electrically-conductive rubber containing uniformly dispersed magnetic powder, is employed (for example, JP-A-53-42738).

JP-A-53-42738 discloses that uneven image density occurs when the moving speed of magnetic toner on the rotating magnetic roller is the same as the moving speed of the photoconductive surface, because the toner layer has uneven thickness in the developing zone, this causing a variable amount of the magnetic toner adhering to the photoconductive surface. To eliminate this defect, JP-A-53-42738 discloses that the photoconductive surface and the magnetic toner are preferred to move in the same direction, and the moving speed $V_T$ of the magnetic toner is preferably larger than the moving speed Vo of the photoconductive surface. Also, it is taught that the best developing effect can be achieved when the moving speeds satisfy the relation, $5 \geqq V_T/Vo \geqq 1.5$.

However, it is necessary to increase the number of rotations of the magnetic roller in order to satisfy the relation, $V_T$=1.5×Vo to 5×Vo. The increasing in the number of rotation brings about increases in the driving torque and generation of tremendous noise. Another problem in this method is a defective printed image such as white streak caused by the adhesion of the toner to the doctor blade or the variation in the toner flowability.

OBJECT AND SUMMARY OF THE INVENTION

Accordingly, an object of the present invention is to provide a method of developing an electrostatic latent image which enables an electrophotographic or electrostatic imaging apparatus to be miniaturized and produces a high quality image.

As a result of the intense research, the inventors have found that the above object can be achieved by a first method in which (1) a magnetic developer containing an electrical insulating toner is attracted on a surface of a developer-transporting roll and transported to a developing zone by the rotation of the developer-transporting roll, the developer-transporting roll consisting essentially of an integrally molded cylindrical permanent magnet member having a plurality of magnetic poles on the surface thereof; and (2) the magnetic developer is brought into contact with the surface of the image-bearing member to develop the electrostatic latent image while keeping the peripheral speed of the developer-transporting roll nearly equal to the moving speed of the image-bearing member.

The inventors have further found that the above object can be achieved by a second method in which (1) a magnetic developer containing an electrical insulating toner is attracted to a surface of a developer-transporting roll and transported to a developing zone by the rotation of the developer-transporting roll, the developer-transporting roll consisting essentially of an elastically deformable cylindrical permanent magnet member integrally molded from a material comprising a magnetic powder, an electrically conductive filler and binder, and a specific volume resistance of the permanent magnet member being $10^7$ Ω.cm or less; and (2) the electrostatic latent image is developed by contacting the permanent magnet member with the surface of the image-bearing member through the magnetic developer while keeping the peripheral speed Vm of the developer-transporting roll nearly equal to the moving speed Vp of the image-bearing member to satisfy the relation: Vm/Vp=0.8 to 1.2.

DETAILED DESCRIPTION OF THE INVENTION

Figure 1:
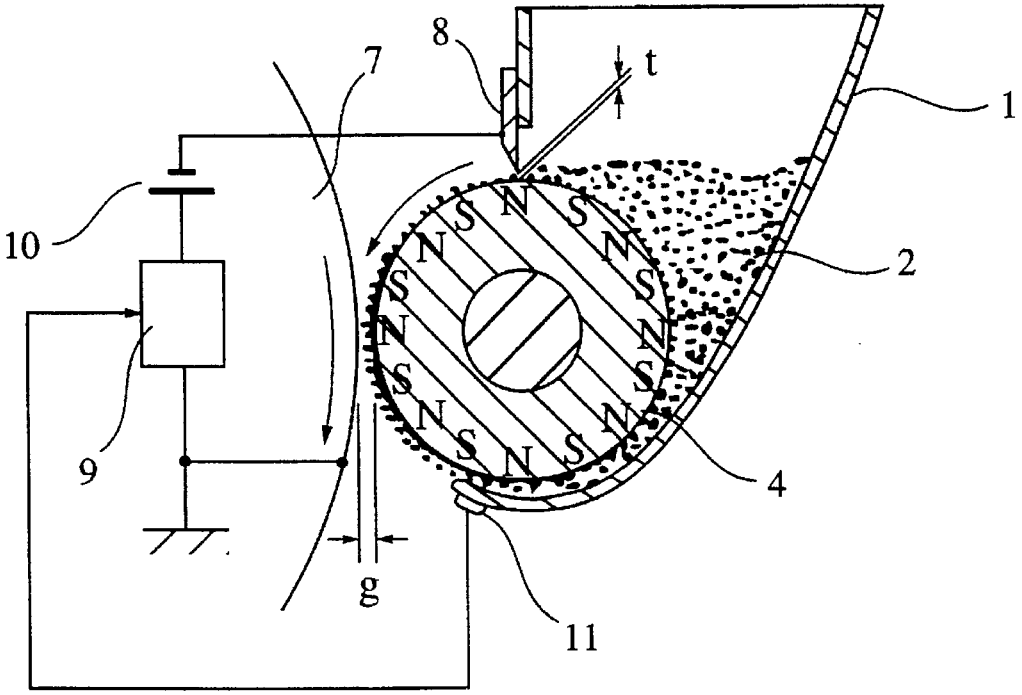
FIG. 1 is a schematic cross sectional view showing an electrophotographic or electrostatic imaging apparatus practicing the method of the present invention.

The present invention will be described below more in detail.

[First Method]

In the first method, the moving directions of the developer-transporting roll and the image-bearing member may be the same or opposite.

The peripheral speed of the developer-transporting roll Vm and the moving speed of the image-bearing member Vp are nearly equal to each other, and preferably satisfy the relation: Vm/Vp=0.8 to 1.2.

The doctor gap t may be nearly the same as the developing gap g in view of producing a high quality image, and preferably t=0.15–0.5 mm, more preferably 0.2–0.4 mm and g–t=0–0.20 mm. In particular, when the developer-transporting roll and the photoconductive drum rotate in the same direction in the developing zone, g–t≦0.05 is preferable in view of producing a high-density image free from uneven density.

The permanent magnet member may be composed of a ferrite magnet or a resin bonded magnet mainly composed of a magnet powder and a resin material which may include one or more of ethylene-ethyl acrylate copolymers, polyamides, chlorinated polyethylenes, etc.

The ferrite magnetic roll may be produced, for example, by preforming a powder of ferrite such as $MO.nFe_2O_3$, wherein M is at least one of Ba, Sr and Pb and n is 5–6, by a rubber press method or by extrusion molding, sintering the preformed product, machining the sintered product to a predetermined size (length and diameter), and magnetizing the machined product after fixing it to a shaft.

The resin bonded magnetic roll may be produced, for example, by kneading while heating a powdery material mainly comprising a magnet powder and a resin material, shaping the kneaded material into a cylindrical shape, etc. by an injection or extrusion molding, and magnetizing the shaped product after inserting a shaft in it (when shaped by injection molding) or fixing it to a shaft (when shaped by extrusion molding).

The permanent magnet member may be a roll integrally molded onto the outer surface of a shaft, or the permanent magnet member and the shaft may be integrally molded from the magnetic material described above. The permanent magnet member is preferred to have no seam on the exterior circumferential surface thereof to avoid uneven development.

The developer-transporting roll may consist of the above permanent magnet member and optionally an electrically conductive layer made of a non-magnetic material formed on the surface of the permanent magnet member.

[Second Method]

The doctor gap t may be nearly the same as the developing gap g, and preferably t=0.1–0.4 mm and g–t=0.1±0.1 mm.

The elastically deformable cylindrical permanent magnet member is produced from a material comprising 50–1500 parts, preferably 300–600 parts by weight of a magnet powder such as hard 1.5 ferrite magnets, rare earth magnets, etc., 5–100 parts, preferably 10–40 parts by weight of an electrically conductive filler such as carbon black, carbon fibers, etc., and 100 parts of an organic polymer binder including a rubber material such as urethane rubbers, silicone rubbers, butyl rubbers, ethylene-propylene terpolymer rubbers, etc. and plastics. In addition, 1–10 parts by weight of a crosslinking agent and a small amount of a plastisizer, an anti-oxidant, a lubricant, an inorganic filler may be contained. The permanent magnet member may be molded by cast molding, injection molding, or extrusion molding, etc. After vulcanization, the molded permanent magnet member is subjected to grinding and magnetization. The permanent magnet member is preferred to have no seam on the exterior circumferential surface thereof to avoid uneven development.

[First and Second Method]

The surface magnetic flux density decreases with the number of the magnetic poles on the exterior circumferential surface of the permanent magnet member, because the N-poles and S-poles are alternatively aligned in the circumferential direction with a small inter-pole pitch. A surface magnetic flux density of 50 G or more is preferred to prevent the magnetic developer from scattering, and 1200 G or less is preferred to readily adhere the toner to the latent image on the image-bearing member. The preferred range for the surface magnetic flux density is 100–800 G. The number of the magnetic poles is preferably 8–60 which corresponds to a surface magnetic flux density of 50–1200 G, and is selected so that the inter-pole pitch is 0.5–10 mm, preferably 1–5 mm.

If the permanent magnet member of the present invention is electrically semiconductive or insulating, the application of bias voltage to the permanent magnet member is preferably made through the doctor blade made of an electrically-conductive material such as metal.

The permanent magnet member is biased by a direct current alone or a superimposed current of a direct current and an alternating current. The frequency (f) of the alternating current to be superimposed on the direct current is preferably lower than the usually utilized frequency of 500 Hz to 1 kHz, and may be determined by the formula, $f(Hz)=M.Vm/\pi.D$, wherein M is the number of magnetic poles, Vm is the peripheral speed (mm/sec), and D is the diameter of the permanent magnet member. The peak-to-peak voltage $V_{p-p}$ is preferably 100–800 V.

It is important that the phase of the superimposed alternating voltage is synchronous with the rotation of the magnetic poles of the permanent magnet member. Therefore, the alternating current supply is regulated so that the applied voltage is minimum when each rotating pole reaches the closest position to the surface of the permanent magnet member, and maximum when the middle point of each adjacent magnetic poles reaches the closest position to the surface of the permanent magnet member. Such a synchronization may be carried out, for example, by utilizing a magnetic sensor for detecting the magnetic field generated by the permanent magnet member as a frequency trigger for the alternating current supply or by taking a synchronous signal of the alternating current supply out of the shaft of the permanent magnet member.

In the method of the present invention, any of the magnetic developer comprising a magnetic toner alone, one comprising a powdery mixture (10–90 weight % toner concentration) of a magnetic toner and a magnetic carrier, and one comprising a powdery mixture (5–60 weight % toner concentration) comprising a non-magnetic toner and a magnetic carrier may be used.

When a two-component magnetic developer is used, a magnetic developer having a predetermined toner concentration is supplied to the toner storage, or only the toner is supplied to the toner storage while allowing the carrier to adhere to the surface of the permanent magnet member. Such a procedure can eliminate a means for controlling the toner concentration to enable the miniaturization of the apparatus.

As the carrier, a magnetic particle such as iron powder, ferrite powder, or magnetite powder, bonded particle comprising a resin containing a dispersed magnetic powder, etc. may be used. The carrier is preferred to have an average particle size of 10–150 μm, preferably 10–100 μm, a specific volume resistance of $10^3$–$10^{13}$ Ω.cm, preferably $10^6$–$10^{10}$ Ω.cm, and a magnetization ($\sigma_{1000}$) of 10 emu/g or more, preferably 30 emu/g or more at 1000 Oe magnetic field. An average particle size exceeding 150 μm is not desirable because the carrier fails to give the toner a sufficient triboelectric charge. When the average particle size is less than 10 μm, the carrier will likely adhere to the image-bearing member. When the specific volume resistance is higher than $10^{13}$ Ω.cm, the developing electrode effect is reduced to cause a low image density, while a specific volume resistance lower than $10^3$ Ω.cm results in the adhesion of the carrier to the image-bearing member. When the magnetization ($\sigma_{1000}$) is lower than 10 emu/g, the carrier will likely adhere to the image-bearing member. With respect to the shape of the carrier, a flat carrier is preferable rather than a spherical carrier in view of preventing toner from adhering to the image-bearing member.

The carrier may be a mixture of two or more of the above magnetic particles. For example, a large-size magnetic particle having an average particle size of 60–120 μm may be mixed with a small-sized magnetic particle having an average particle size of 10–50 μm or a small-sized bonded magnetic particle having an average particle size of 10–50 μm. The mixing ratio may be determined depending upon the particle size, magnetic properties, etc.

The toner may be either magnetic or non-magnetic. In view of high transferring efficiency, the toner is preferred to be electrically insulating, i.e., have a specific volume resistance of $10^{14}$ Ω.cm or more. Also, a toner which can be easily triboelectrically charged (easily reaches a triboelectric charge of 10 μC/g or more) by the friction with the carrier and/or the doctor blade, etc. is preferable. The average particle size of the toner may be 5–15 μm, preferably 6–10 μm.

The toner composition may be the same as those known in the art. Generally, the toner comprises a binder resin (styrene-acrylic copolymer, polyester resin, etc.) and a colorant (carbon black, etc., however not needed to be used when magnetite is used for a magnetic powder component) as the essential component, and a magnetic powder (magnetite, soft ferrite, etc.), a charge-controlling agent (nigrosine, metal-containing azo dye, etc.), a lubricant (polyolefin, etc.) and a flowability improver (hydrophobic silica) as the optional component. When the magnetic powder is used, the content thereof in the toner is preferably 20–70 weight %, and more preferably 30–50 weight % because a content lower than 20 weight % causes toner scattering and a content higher than 70 weight % results in defective fixing. A color toner may be also produced by suitably selecting the colorant.

In the present invention, the magnetization and the volume-average particle size of the toner were measured by a vibrating magnetometer (VSM-3 manufactured by Toei Kogyo K. K.) and a particle size analyzer (Coulter Counter Model TA-II manufactured by Coulter Electronics Co.), respectively. The weight-average particle size of the carrier was calculated from a particle size distribution obtained by a multi-sieve shaking machine.

The specific volume resistances of the toner and the carrier were determined as follows. An appropriate amount (several tens mg) of the chargeable toner or magnetic carrier was charged into a dial-gauge type cylinder made of Teflon (trade name) and having an inner diameter of 3.05 mm (0.073 $cm^2$ cross section). The sample was exposed to an electric field of D.C. 4000 V/cm (toner) or D.C. 200 V/cm (carrier) under a load of 0.1 kgf to measure an electric resistance using an insulation-resistance tester (4329A type manufactured by Yokogawa-Hewlett-Packard, Ltd.).

The triboelectric charge of the toner was determined as follows. A developer (reference ferrite carrier: KBN-100 manufactured by Hitachi Metals, Ltd.) having a toner content of 5 weight % was mixed well, and blown at a blowing pressure of 1.0 kgf/$cm^2$. The triboelectric charge of the toner thus treated was measured by using a blow-off powder electric charge measuring apparatus (TB-200 manufactured by Toshiba Chemical Co. Ltd.).

With the above construction, an image of high quality free from background fogging, toner scattering, blur in slender line, uneven density, etc. may be reproduced even by a sleeve-less apparatus of a reduced size.

Figure 2:
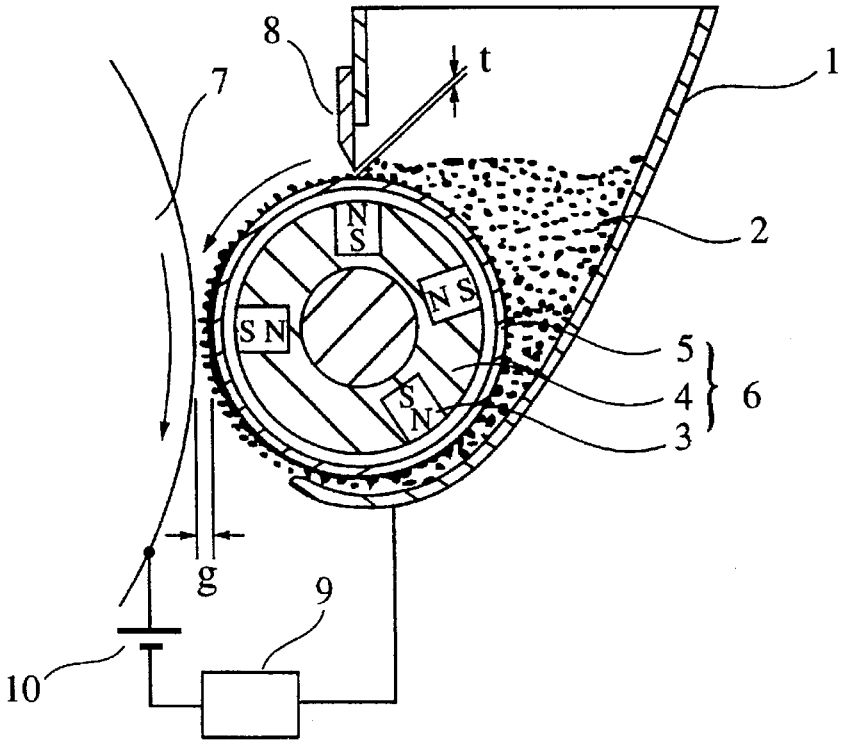
FIG. 2 PRIOR ART
FIG. 2 is a schematic cross sectional view showing an electrophotographic or electrostatic imaging apparatus practicing the conventional method.

For a general understanding of the features of the present invention, reference is made to FIG. 1 which schematically shows an electrophotographic recording apparatus for practicing the method of the present invention, in which the sleeve-less developing means is employed. In FIGS. 1 and 2, the like reference numerals have been used throughout to designate identical elements.

In FIG. 1, the cylindrical permanent magnet member 4 is integrally molded from an electrically semiconductive or insulating magnet material, for example an isotropic ferrite magnet, having a specific volume resistance exceeding $10^6$ Ω.cm (first method) or a magnet material having a specific volume resistance of $10^7$ Ω.cm or less such as a rubber magnet (second method). The permanent magnet member 4 has on its exterior circumferential surface a plurality of magnetic poles extending along the axial direction and disposed in the lower portion of the toner storage 1 so as to rotate around or together with the shaft. The alternating current supply 9 and the direct current supply 10 are connected in series between the doctor blade 8 and the photoconductive drum 7 (image-bearing member) in such a manner that an alternating electric field by the direct bias superimposed with the alternating bias may be applied between the photoconductive drum 7 and the magnetic developer 2 attracted on and transported by the permanent magnet member 4. The alternating current supply 9 may be omitted. The reference numeral 11 is a magnetic sensor optionally used for synchronizing the phase of the superimposed alternating voltage with the rotation of the magnetic poles of the permanent magnet member 4.

The present invention will be further described while referring to the following Examples which should be considered to illustrate various preferred embodiments of the present invention.

EXAMPLES 1–9 AND COMPARATIVE EXAMPLES 1–2

By using the apparatus described above, the image forming tests were conducted as follows.

A magnetic toner was prepared as follows. A starting mixture consisting, by weight part, of:

57 parts of styrene/n-butyl methacrylate copolymer (weight average-molecular weight (Mw)=$21\times10^4$, number-average molecular weight (Mn)=$1.6\times10^4$), 40 parts of magnetite (EPT500 manufactured by Toda kogyo K. K.), 2 parts of polypropylene (TP32 manufactured by Sanyo Chemical Industries, Ltd.), and 1 part of a negatively chargeable charge-controlling agent (Bontron E-81 manufactured by Orient Chemical Industries)

was kneaded under heating, solidified by cooling, pulverized and classified to obtain a particle having an average particle size of 10 μm. The surface of the particle thus obtained was uniformly coated with 0.5 parts by weight of a flowability improver (hydrophobic silica, Aerosil R972 manufactured by Nippon Aerosil K. K.), thereby producing a negatively chargeable magnetic toner. The magnetic toner had a specific volume resistance of $5\times10^{14}$ Ω.cm and a triboelectric charge of −22 μC/g.

A magnetic carrier having an average particle size of 50 μm was prepared by coating a ferrite carrier (KBN-100 manufactured by Hitachi Metals, Ltd.) with a silicone resin. The specific volume resistance was $10^8$ Ω.cm.

A magnetic developer (toner content: 50 weight %) was prepared by mixing the above magnetic toner and magnetic carrier. By using the magnetic developer thus prepared, the image forming test was carried out under the following conditions.

The photoconductive drum 7 was made of an organic photoconductive material and rotated at each peripheral speed of 25 mm/sec, 50 mm/sec and 100 mm/sec. The surface of the photoconductive drum 7 was charged to −600 V.

The permanent magnet member 4 (developer-transporting roll) having the following characteristics:

outer diameter:20 mm, length:A4 size, number of magnetic pole:32, surface magnetic flux density:350 G, developing gap (g):0.4 mm, and doctor gap (t):0.3 mm was made of a ferrite magnet (YBM-3 manufactured by Hitachi Metals, Ltd.). The permanent magnet member 4 was biased to −500 V by a direct bias current through the doctor blade 8 made of brass.

The developed toner image was corona transferred and fixed on a recording sheet by a heat roll at 180° C. under a line pressure of 1 kg/cm. The developing and fixing operations were conducted at 20° C. and 60% R.H. The results of the tests are shown in Table 1.

TABLE 1

| | Vp (mm/sec) | Vm (mm/sec) | Vm/Vp | Image Density | Background Fogging | Toner Scattering | Slender Line Blur |
|---|---|---|---|---|---|---|---|
| Example | | | | | | | |
| 1 | 25 | 20 | 0.8 | 1.40 | none | none | none |
| 2 | 25 | 25 | 1.0 | 1.42 | none | none | none |
| 3 | 25 | 30 | 1.2 | 1.45 | none | none | none |
| 4 | 100 | 100 | 1.0 | 1.43 | none | none | none |
| 5 | 200 | 200 | 1.0 | 1.40 | none | none | none |
| Comparative Example | | | | | | | |
| 1 | 25 | 15 | 0.6 | 1.18 | occurred | none | none |
| 2 | 25 | 125 | 5.0 | 1.45 | none | none | none |

As can be seen from Table 1, when the Vm/Vp ratio is too small (Comparative Example 1), the image density was low and background fogging occurred. Comparative Example 2 (large Vm/Vp ratio) was free from image defects, however, the driving torque increased to generate a large noise. On the other hand, Examples 1–3 produced images of high quality without causing any trouble. The results would demonstrate that the Vm/Vp ratio is preferred to be 0.8–1.2.

Examples 4 and 5, in which the high-speed development was conducted under the condition of Vm/Vp=1, also produced images of high quality without causing any trouble.

When the moving speeds of the permanent magnet member 4 and the photoconductive drum 7 are nearly the same, the contact time of the magnetic developer with the electrostatic latent image can be prolonged. This increases the image density and prevents the magnetic developer from being swept toward the rotation direction of the permanent magnet member 4, thereby avoiding the defect such as background fogging.

Next, the image forming tests were conducted under the following conditions:

peripheral speed:

permanent magnet member:25 mm/sec, photoconductive drum:25 mm/sec, developing gap (g):0.4 mm, 0.035 mm or 0.3 mm, doctor gap (t):0.3 mm while rotating the permanent magnet member 4 in the same or opposite direction with respect to the rotation direction, in the developing zone, of the photoconductive drum. The magnetic developer and the conditions other than the above were the same as those employed in the preceding tests. The results are shown in Table 2.

TABLE 2

| | Rotation Direction | g (mm) | t (mm) | Image Density | Background Fogging | Slender Line Blur | Unevenness in Density |
|---|---|---|---|---|---|---|---|
| Example | | | | | | | |
| 6 | same | 0.4 | 0.3 | 1.42 | none | none | >0.1 |
| 7 | same | 0.3 | 0.3 | 1.32 | none | none | ≦0.1 |
| 8 | same | 0.35 | 0.3 | 1.28 | none | none | ≦0.1 |
| 9 | opposite | 0.4 | 0.3 | 1.40 | none | none | ≦0.1 |

Note:
The unevenness in density is represented by the difference in image density between two portions of a solid black image, one corresponding to the magnetic pole and the other corresponding to the intervening portion of the adjacent magnetic poles.

As seen from Table 2, the image density of Example 6 was uneven. Such an unevenness in image density was remarkable in the solid black area. On the other hand, there was no unevenness in the image density in Examples 7–9. In Examples 7 and 8, since the developing gap (g) and the doctor gap (t) were the same and g−t=0.05 mm, the magnetic developer was accumulated in the developing zone, thus effectively preventing the uneven image density. In Example 9, since the moving directions of the permanent magnet member and the photoconductive drum in the developing zone are opposite, the magnetic developer was accumulated in the developing zone regardless of the dimension of g and t.

EXAMPLES 10–14 AND COMPARATIVE EXAMPLES 3–5

By using the same apparatus used in the preceding tests except that the permanent magnet member 4 was prepared as shown below, the image forming tests were conducted.

The permanent magnet member 4 (developer-transporting roll) was composed of a 16-pole rubber magnet roll having 20 mm outer diameter and 227 mm length which was integrally fixed on a SUM shaft having 6 mm diameter and 280 mm length. The rubber magnet roll comprised, by weight basis, 80 parts of Ba-ferrite powder having an average particle size of 1 μm, 15 parts of urethane rubber and 5 parts of carbon black. The surface magnetic flux density was 150 G and the specific volume resistance was $10^3$ Ω.cm.

The development was carried out by using the same magnetic developer as used in the preceding examples.

The OPC drum 7 (image-bearing member) having an outer diameter of 30 mm was charged to −600 V and rotated at a respective peripheral speed (Vp) of 60, 150 and 250 mm/sec. The permanent magnet member 4 was biased to −500 V by a direct bias current. The developing gap (g) and the doctor gap (t) were respectively set to 0 mm and 0.1 mm.

After a roll transferring, the developed toner image was fixed by a heat roll on a recording paper in the same manner as in the preceding tests. The developing and fixing operations were conducted at 20° C. and 60% R.H. The results of the tests are shown in Table 3.

TABLE 3

| | Vp (mm/sec) | Vm (mm/sec) | Vm/Vp | Image Density | Background Fogging (Density) | Toner Scattering | Slender Line Blur |
|---|---|---|---|---|---|---|---|
| Example | | | | | | | |
| 10 | 60 | 48 | 0.8 | 1.27 | 0.06 | none | none |
| 11 | 60 | 60 | 1.0 | 1.32 | 0.07 | none | none |
| 12 | 60 | 72 | 1.2 | 1.34 | 0.08 | none | none |
| 13 | 150 | 150 | 1.0 | 1.30 | 0.09 | none | none |
| 14 | 250 | 250 | 1.0 | 1.28 | 0.10 | none | none |
| Comparative Example | | | | | | | |
| 3 | 60 | 30 | 0.5 | 0.78 | 0.07 | none | occurred |
| 4 | 60 | 90 | 1.5 | 1.36 | 0.13 | none | occurred |
| 5 | 60 | 120 | 2.0 | 1.29 | 0.16 | occurred | occurred |

As seen from Table 3, when the Vm/Vp ratio was small (Comparative Example 3), the image density was lowered and the slender line was blurred. When the Vm/Vp ratio was large (Comparative Examples 4 and 5), the background fogging increased, and the toner scattering and slender line blur occurred. On the other hand, when Vm and Vp were the same or nearly the same (Examples 10–14), clear images of high quality were produced without no defect. Also, the image of high quality was produced even when the photoconductive drum rotated at a high speed (Examples 13 and 14).

The effects achieved by the construction and function described above will be summarized below.

(1) Since the developing roll consist of only the permanent magnet member, the developing roll and the electrophotographic recording apparatus can be miniaturized (first and second methods).

(2) Since the peripheral speed of the developing roll (permanent magnet member) is the same or nearly the same as the moving speed of the image-bearing member (photoconductive drum), a high-speed development can be effectively performed (first and second methods).

(3) Since the permanent magnet member serving as the developer-transporting roll is made of a hard material, the surface thereof is hardly worn. Therefore, the surface is little changed with time to strengthen the durability of the permanent magnet member (first method).

(4) An image of stable and high quality can be produced even at a large developing gap (first method).

(5) Since the permanent magnet member serving as the developer-transporting roll is made of a rubber material, the magnetic developer is securely transported and the contact pressure of the permanent magnet member with the photoconductive drum can be reduced (second method).

(6) Since the toner concentration of the magnetic developer can be selected from the wide range, a means for controlling toner concentration is not needed to enable a recording apparatus to be miniaturized (first and second methods).

What is claimed is:

1. A method of developing an electrostatic latent image on a rotating image-bearing member with a magnetic developer, wherein a magnetic developer containing an electrical insulating toner is attracted on a surface of a sleeveless developer-transporting roll and transported to a developing zone by the rotation of the sleeveless developer-transporting roll, the sleeveless developer-transporting roll consisting of an integrally molded cylindrical permanent magnet member having a plurality of magnetic poles on the surface thereof; and the magnetic developer is brought into contact with the surface of the image-beating member to develop the electrostatic latent image while keeping the relationship between the peripheral speed Vm of the sleeveless developer-transporting roll and the moving speed Vp of the image-beating member within the range whereby $0.8 \leqq Vm/Vp < 1.2$.

2. The method according to claim 1, wherein a doctor gap t and a developing gap g satisfy the following equations; $0.15 \leqq t \leqq 0.5$ mm and $0 \leqq (g-t) \leqq 0.1$ mm.

3. The method according to claim 2, wherein the sleeveless developer-transporting roll rotates in the same direction as the moving direction of the image-bearing member in the developing zone, and the doctor gap t and the developing gap g satisfy the relation: $g-t \leqq 0.05$ mm.

4. The method according to claim 1, wherein the sleeveless developer-transporting roll rotates in the opposite direction to the moving direction of the image-bearing member in the developing zone.

5. A method of developing an electrostatic latent image on a rotating image-bearing member with a magnetic developer, wherein a magnetic developer containing an electrical insulating toner is attracted on a surface of a sleeveless developer-transporting roll and transported to a developing zone by the rotation of the sleeveless developer-transporting roll, the sleeveless developer-transporting roll consisting essentially of an elastically deformable cylindrical permanent magnetic member integrally molded from a material comprising a magnetic powder, an electrically conductive filler and a binder resin, and a specific volume resistance of the permanent magnetic member being $10^7$ Ω.cm or less; and the electrostatic latent image is developed by contacting the permanent magnetic member with the surface of the image-bearing member through the magnetic developer layer while keeping the peripheral speed Vm of the sleeveless developer-transporting roll nearly equal to the moving speed Vp of the image-beating member to satisfy the equation: $0.8 \leqq Vm/Vp \leqq 1.2$.

6. The method according to claim 5, wherein a doctor gap is 0.1–0.4 mm and the doctor gap and a developing gap satisfy the relation: $g-t=0.1 \pm 0.1$ mm, wherein g is the developing gap and t is the doctor gap.

* * * * *